US011393396B2

(12) United States Patent
Yang et al.

(10) Patent No.: US 11,393,396 B2
(45) Date of Patent: Jul. 19, 2022

(54) PIXEL CIRCUIT AND DRIVING METHOD THEREFOR AND DISPLAY PANEL

(71) Applicant: BOE TECHNOLOGY GROUP CO., LTD., Beijing (CN)

(72) Inventors: Qian Yang, Beijing (CN); Libin Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/293,536

(22) PCT Filed: Aug. 10, 2020

(86) PCT No.: PCT/CN2020/108056

§ 371 (c)(1),
(2) Date: May 13, 2021

(87) PCT Pub. No.: WO2021/068637

PCT Pub. Date: Apr. 15, 2021

(65) Prior Publication Data

US 2022/0028338 A1 Jan. 27, 2022

(30) Foreign Application Priority Data

Oct. 12, 2019 (CN) ..... 201910968491.1

(51) Int. Cl.

| | |
|---|---|
| ***G09G 3/3241*** | (2016.01) |
| ***G09G 3/20*** | (2006.01) |
| ***G09G 3/3291*** | (2016.01) |

(52) U.S. Cl.

CPC ..... *G09G 3/3241* (2013.01); *G09G 3/2092* (2013.01); *G09G 3/3291* (2013.01); *G09G 2310/061* (2013.01)

(58) Field of Classification Search

CPC .. G09G 3/3241; G09G 3/2092; G09G 3/3291; G09G 2310/061

See application file for complete search history.

(56) References Cited

U.S. PATENT DOCUMENTS

2019/0259331 A1 8/2019 Na
2021/0225293 A1* 7/2021 Wang ..... G09G 3/3266

FOREIGN PATENT DOCUMENTS

CN 107068060 A 8/2017
CN 108831378 A 11/2018

(Continued)

*Primary Examiner* — Kenneth B Lee, Jr.
(74) *Attorney, Agent, or Firm* — Dilworth & Barrese, LLP.; Michael J. Musella, Esq.

(57) ABSTRACT

A pixel circuit and a driving method thereof, and a display panel. The pixel circuit includes a reset circuit, a data writing circuit, a compensation circuit, and a driving circuit. The reset circuit is configured to apply a reset voltage to the first terminal of the light-emitting element to reset the first terminal of the light-emitting element; the data writing circuit is configured to write a data signal to the first terminal of the driving circuit; the compensation circuit is configured to write the reset voltage into the control terminal of the driving circuit when the reset circuit applies the reset voltage, and to write a compensation signal based on the data signal into the control terminal of the driving circuit when the data writing circuit writes the data signal; and the driving circuit is configured to control a driving current for driving the light-emitting element to emit light.

15 Claims, 10 Drawing Sheets

(56) References Cited

FOREIGN PATENT DOCUMENTS

| | | | |
|---|---|---|---|
| CN | 110136650 | A | 8/2019 |
| CN | 110223636 | A | 9/2019 |
| CN | 110268465 | A | 9/2019 |
| CN | 110660360 | A | 1/2020 |

* cited by examiner

PIXEL CIRCUIT AND DRIVING METHOD THEREFOR AND DISPLAY PANEL

CROSS-REFERENCE TO RELATED APPLICATION

The present application claims priority of Chinese Patent Application No. 201910968491.1, filed on Oct. 12, 2019, and the entire content disclosed by the Chinese patent application is incorporated herein by reference as part of the present application.

TECHNICAL FIELD

The embodiments of the present disclosure relate to a pixel circuit and a driving method thereof, and a display panel.

BACKGROUND

Generally, pixel circuits in organic light-emitting diode (OLED) display devices adopt a matrix driving mode, the matrix driving mode includes an active matrix (AM) driving mode and a passive matrix (PM) driving mode according to whether switching elements are introduced into each pixel unit. Passive matrix-driven organic light-emitting diodes (PMOLED) have simple process and low cost, but the passive matrix-driven organic light-emitting diodes cannot meet the requirements of high resolution and large-size display due to the shortcomings such as cross-talk, high power consumption, and short life, etc. In contrast, active matrix-driven organic light-emitting diodes (AMOLED) integrate a group of thin film transistors and storage capacitors in the pixel circuit of each pixel, and by controlling the driving of the thin film transistors and storage capacitors, the current flowing through the OLED can be controlled, so that the OLED can emit light as required. Compared with PMOLED, AMOLED needs a less driving current, lower power consumption, and longer service life, and can meet the requirements of large-size display with high resolution and multi-gray scale.

In the AMOLED pixel circuit, the OLED is driven to emit light by a driving transistor, and the stability of a gate voltage of the driving transistor will directly affect the light-emitting state of the OLED, so it is very important to keep the gate voltage of the driving transistor stable in the light-emitting phase.

SUMMARY

At least one embodiment of the present disclosure provides a pixel circuit, and the pixel circuit comprises a reset circuit, a data writing circuit, a compensation circuit, and a driving circuit. The reset circuit is connected to a first terminal of a light-emitting element, and is configured to apply a reset voltage to the first terminal of the light-emitting element under control of a reset control signal to reset the first terminal of the light-emitting element; the data writing circuit is connected to a first terminal of the driving circuit, and is configured to write a data signal to the first terminal of the driving circuit under control of a scanning signal; the compensation circuit is connected to a second terminal and a control terminal of the driving circuit, and is configured to, under control of a compensation control signal, write the reset voltage into the control terminal of the driving circuit in a case where the reset circuit applies the reset voltage, and to write a compensation signal, which is based on the data signal, into the control terminal of the driving circuit in a case where the data writing circuit writes the data signal; and the driving circuit is configured to control a driving current for driving the light-emitting element to emit light under control of a voltage applied to the control terminal of the driving circuit.

For example, in the pixel circuit provided by an embodiment of the present disclosure, the driving circuit comprises a driving transistor, the control terminal of the driving circuit comprises a gate electrode of the driving transistor, the first terminal of the driving circuit comprises a first electrode of the driving transistor, and a second terminal of the driving circuit comprises a second electrode of the driving transistor.

For example, in the pixel circuit provided by an embodiment of the present disclosure, the compensation circuit comprises a first transistor. A gate electrode of the first transistor is configured to receive the compensation control signal, a first electrode of the first transistor is connected to the second terminal of the driving circuit, and a second electrode of the first transistor is connected to the control terminal of the driving circuit.

For example, in the pixel circuit provided by an embodiment of the present disclosure, the driving transistor is a polysilicon transistor, the first transistor is an oxide transistor, and a type of the first transistor is opposite to a type of the driving transistor.

For example, the pixel circuit provided by an embodiment of the present disclosure further comprises a first light-emitting control circuit. The first light-emitting control circuit is connected to the first terminal of the light-emitting element and the second terminal of the driving circuit, and is configured to control a connection between the second terminal of the driving circuit and the first terminal of the light-emitting element to be turned off or turned on under control of a first light-emitting control signal.

For example, in the pixel circuit provided by an embodiment of the present disclosure, the first light-emitting control circuit comprises a second transistor, a gate electrode of the second transistor is configured to receive the first light-emitting control signal, a first electrode of the second transistor is connected to the second terminal of the driving circuit, and a second electrode of the second transistor is connected to the first terminal of the light-emitting element.

For example, the pixel circuit provided by an embodiment of the present disclosure further comprises a second light-emitting control circuit. The second light-emitting control circuit is connected to a first voltage terminal and the first terminal of the driving circuit, and is configured to control a connection between the first voltage terminal and the first terminal of the driving circuit to be turned off or tuned on under control of a second light-emitting control signal.

For example, in the pixel circuit provided by an embodiment of the present disclosure, the second light-emitting control circuit comprises a third transistor, a gate electrode of the third transistor is configured to receive the second light-emitting control signal, a first electrode of the third transistor is connected to the first voltage terminal, and a second electrode of the third transistor is connected to the first terminal of the driving circuit.

For example, in the pixel circuit provided by an embodiment of the present disclosure, a type of the third transistor is opposite to a type of the first transistor, and a phase of the second light-emitting control signal is identical to a phase of the compensation control signal; or, the type of the third transistor is identical to the type of the first transistor, and the phase of the second light-emitting control signal is opposite to the phase of the compensation control signal.

For example, in the pixel circuit provided by an embodiment of the present disclosure, the first light-emitting control signal and the second light-emitting control signal are different.

For example, in the pixel circuit provided by an embodiment of the present disclosure, the reset circuit comprises a fourth transistor, a gate electrode of the fourth transistor is configured to receive the reset control signal, a first electrode of the fourth transistor is connected to a reset voltage terminal to receive the reset voltage, and a second electrode of the fourth transistor is connected to the first terminal of the light-emitting element.

For example, in the pixel circuit provided by an embodiment of the present disclosure, the data writing circuit comprises a fifth transistor, a gate electrode of the fifth transistor is configured to receive the scanning signal, a first electrode of the fifth transistor is configured to receive the data signal, and a second electrode of the fifth transistor is connected to the first terminal of the driving circuit.

For example, in the pixel circuit provided by an embodiment of the present disclosure, a type of the second transistor is identical to a type of the fifth transistor, and a phase of the first light-emitting control signal is opposite to a phase of the scanning signal; or, the type of the second transistor is opposite to the type of the fifth transistor, and the phase of the first light-emitting control signal is identical to the phase of the scanning signal.

For example, the pixel circuit provided by an embodiment of the present disclosure further comprises a storage circuit. The storage circuit is configured to store the compensation signal and hold the compensation signal at the control terminal of the driving circuit.

For example, in the pixel circuit provided by an embodiment of the present disclosure, the storage circuit comprises a storage capacitor, a first terminal of the storage capacitor is connected to a second voltage terminal, and a second terminal of the storage capacitor is connected to the control terminal of the driving circuit.

At least one embodiment of the present disclosure provides a pixel circuit, the pixel circuit comprises: a reset circuit, a data writing circuit, a compensation circuit, a storage circuit, a driving circuit, a first light-emitting control circuit, and a second light-emitting control circuit. The driving circuit comprises a driving transistor, the compensation circuit comprises a first transistor, the first light-emitting control circuit comprises a second transistor, the second light-emitting control circuit comprises a third transistor, the reset circuit comprises a fourth transistor, the data writing circuit comprises a fifth transistor, and the storage circuit comprises a storage capacitor. A gate electrode of the first transistor is configured to receive a compensation control signal, a first electrode of the first transistor is connected to a second electrode of the driving transistor, and a second electrode of the first transistor is connected to a gate electrode of the driving transistor; a gate electrode of the second transistor is configured to receive a first light-emitting control signal, a first electrode of the second transistor is connected to the second electrode of the driving transistor, and a second electrode of the second transistor is connected to a first terminal of a light-emitting element; a gate electrode of the third transistor is configured to receive a second light-emitting control signal, a first electrode of the third transistor is connected to a first voltage terminal, and a second electrode of the third transistor is connected to a first electrode of the driving transistor; a gate electrode of the fourth transistor is configured to receive a reset control signal, a first electrode of the fourth transistor is configured to receive a reset voltage, and a second electrode of the fourth transistor is connected to the first terminal of the light-emitting element; a gate electrode of the fifth transistor is configured to receive a scanning signal, a first electrode of the fifth transistor is configured to receive a data signal, and a second electrode of the fifth transistor is connected to the first electrode of the driving transistor; a first terminal of the storage capacitor is connected to a second voltage terminal, and a second terminal of the storage capacitor is connected to the gate electrode of the driving transistor; and a second terminal of the light-emitting element is connected to a third voltage terminal; the driving transistor is a polysilicon transistor, the first transistor is an oxide transistor, and a type of the first transistor is opposite to a type of the driving transistor; and the first transistor is configured to, under control of the compensation control signal, write the reset voltage to the gate electrode of the driving transistor in a case where the fourth transistor applies the reset voltage, and to write a compensation signal, which is based on the data signal, to the gate electrode of the driving transistor in a case where the fifth transistor writes the data signal.

At least one embodiment of the present disclosure provides a display panel, and the display panel comprises a pixel array, the pixel array comprises a plurality of pixel units, and at least one pixel unit of the plurality of pixel units comprises the pixel circuit provided in any one embodiment of the present disclosure.

At least one embodiment of the present disclosure provides a driving method of the pixel circuit, and the driving method comprises: in a reset phase, applying the reset voltage to the first terminal of the light-emitting element by the reset circuit to reset the first terminal of the light-emitting element, and the reset circuit applying the reset voltage to the control terminal of the driving circuit via the compensation circuit to reset the control terminal of the driving circuit; in a charging phase, writing the data signal into the first terminal of the driving circuit by the data writing circuit, and writing the compensation signal, which is based on the data signal, into the control terminal of the driving circuit by the compensation circuit; and in a light-emitting phase, driving the light-emitting element to emit light by the driving circuit.

For example, in the driving method provided by an embodiment of the present disclosure, the reset circuit comprises a fourth transistor; the driving circuit comprises a driving transistor, and the control terminal of the driving circuit comprises a gate electrode of the driving transistor; the compensation circuit comprises a first transistor; at the reset phase, the fourth transistor is turned on under control of the reset control signal, the first transistor is turned on under control of the compensation control signal, the reset voltage is applied to the first terminal of the light-emitting element by the fourth transistor to reset the first terminal of the light-emitting element, and the fourth transistor applies the reset voltage to the gate electrode of the driving transistor via the first transistor to reset the gate electrode of the driving transistor.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

In order to make objects, technical solutions, and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments of the present disclosure, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
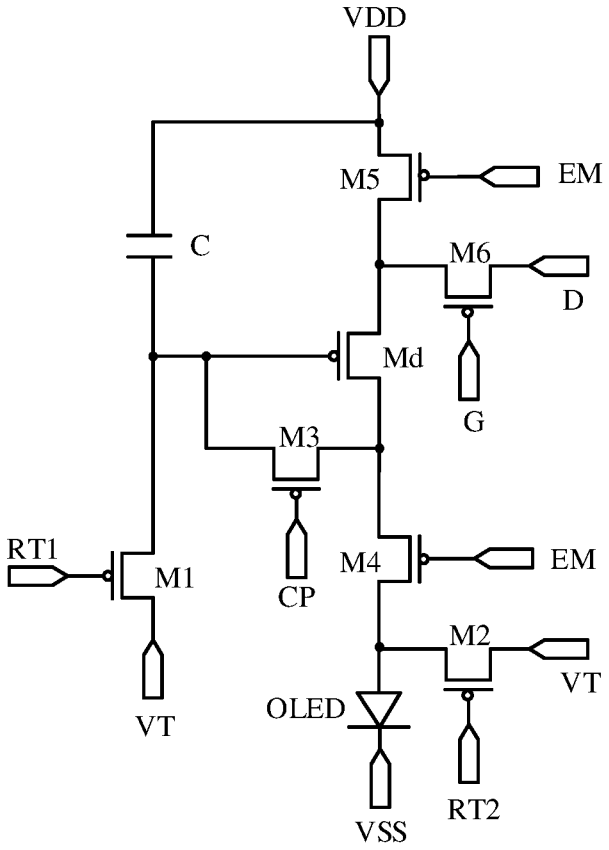
FIG. 1 is a circuit structure diagram of a pixel circuit.

FIG. 1 is a circuit structure diagram of a pixel circuit for an organic light-emitting diode (OLED) display device. As illustrated in FIG. 1, the pixel circuit includes transistors M1-M6, a driving transistor Md, and a capacitor C. In the pixel circuit, a gate electrode of the transistor M1 is connected to a first reset control signal line RT1, a first electrode of the transistor M1 is connected to a gate electrode of the driving transistor Md, a second electrode of the transistor M1 is connected to a reset voltage terminal VT, and the transistor M1 is configured to reset the gate electrode of the driving transistor Md; a gate electrode of the transistor M2 is connected to a second reset control signal line RT2, a first electrode of the transistor M2 is connected to an anode of the organic light-emitting diode (OLED), a second electrode of the transistor T2 is connected to the reset voltage terminal VT, and the transistor M2 is configured to reset the anode of the OLED; a gate electrode of the transistor M3 is connected to a compensation control signal line CT, a first electrode of the transistor M3 is connected to the gate electrode of the driving transistor Md, and a second electrode of the transistor M3 is connected to a second electrode of the driving transistor Md, and the transistor M3 is configured to compensate a threshold voltage of the driving transistor Md.

In the case where the pixel circuit illustrated in FIG. 1 is in a reset phase, the transistor M1 and the transistor M2 are turned on, so that the gate electrode of the driving transistor Md and the anode of the OLED are reset, respectively. In the case where the pixel circuit illustrated in FIG. 1 is in a data writing phase, under the control of a gate signal provided by a gate line G and a compensation control signal provided by the compensation control signal line CT, both the transistor M3 and the transistor M6 are turned on, in addition, the driving transistor Md is also turned on, so that a compensation signal, which is based on the data signal provided by the data terminal D, is written to the gate electrode of the driving transistor Md. In the case where the pixel circuit illustrated in FIG. 1 is in a light-emitting phase, under the control of a light-emitting control signal provided by the light-emitting control terminal EM, both the transistor M4 and the transistor M5 are turned on, in addition, the driving transistor Md is also turned on, so that a driving current can flow to the OLED to drive the OLED to emit light. In the light-emitting phase, although the transistor M1 and the transistor M3 are turned off, the leakage current flowing through the transistor M1 and the transistor M3 will cause the gate voltage of the driving transistor Md to change, thereby causing the driving current flowing from the driving transistor Md to the OLED to be unstable, which makes the OLED prone to flicker upon emitting light and seriously affects the display quality.

At least one embodiment of the present disclosure provides a pixel circuit, the pixel circuit includes a reset circuit, a data writing circuit, a compensation circuit, and a driving circuit. The reset circuit is connected to a first terminal of a light-emitting element, and is configured to apply a reset voltage to the first terminal of the light-emitting element under control of a reset control signal to reset the first terminal of the light-emitting element. The data writing circuit is connected to a first terminal of the driving circuit, and is configured to write a data signal to the first terminal of the driving circuit under control of a scanning signal. The compensation circuit is connected to a second terminal and a control terminal of the driving circuit, and is configured to, under control of a compensation control signal, write the reset voltage into the control terminal of the driving circuit in a case where the reset circuit applies the reset voltage, and to write a compensation signal, which is based on the data signal, into the control terminal of the driving circuit in a case where the data writing circuit writes the data signal. The driving circuit is configured to control a driving current for driving the light-emitting element to emit light under control of a voltage applied to the control terminal of the driving circuit.

In the pixel circuit provided by the embodiment of the present disclosure, the reset circuit can apply the reset voltage to the first terminal of the light-emitting element to reset the first terminal of the light-emitting element, and the reset circuit can also apply the reset voltage to the control terminal of the driving circuit via the compensation circuit to reset the control terminal of the driving circuit, therefore, in the pixel circuit provided by the embodiment of the present disclosure, only one reset circuit is required to reset the first terminal of the light-emitting element and the control terminal of the driving circuit at the same time, thereby simplifying the circuit structure and saving the cost. In addition, in the pixel circuit provided by the embodiment of the present disclosure, the reset circuit is not directly connected to the control terminal of the driving circuit, so that the leakage current in the reset circuit will not affect the signal of the control terminal of the driving circuit in the light-emitting phase, so that the driving current flowing from the driving circuit to the light-emitting element can be kept stable, and the flicker phenomenon can be avoided to occur when the light-emitting element emits light.

Figure 2:
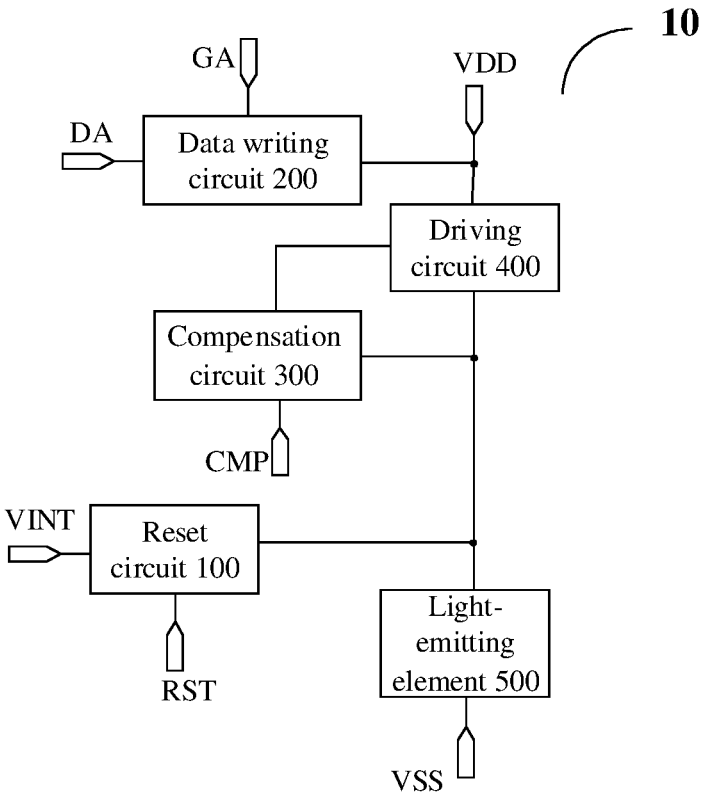
FIG. 2 is a block diagram of a pixel circuit provided by an embodiment of the present disclosure.

FIG. 2 is a block diagram of a pixel circuit provided by an embodiment of the present disclosure. As illustrated in FIG. 2, the pixel circuit 10 includes a reset circuit 100, a data writing circuit 200, a compensation circuit 300, and a driving circuit 400. For example, the pixel circuit 10 provided by the embodiment of the present disclosure can be applied to a display panel, such as an OLED display panel and the like.

As illustrated in FIG. 2, the reset circuit 100 is connected to a first terminal of a light-emitting element 500, a reset control signal line RST, and a reset voltage terminal VINT, and is configured to apply a reset voltage provided by the reset voltage terminal VINT to the first terminal of the light-emitting element 500 under the control of a reset control signal provided by the reset control signal line RST to reset the first terminal of the light-emitting element 500.

For example, the reset voltage may be a low level voltage.

As illustrated in FIG. 2, the data writing circuit 200 is connected to a first terminal of the driving circuit 400, a scanning signal line GA, and a data signal line DA, and is configured to write a data signal provided by the data signal line DA into the driving circuit 400 under the control of a scanning signal provided by the scanning signal line GA.

As illustrated in FIG. 2, the compensation circuit 300 is connected to a second terminal of the driving circuit 400, a control terminal of the driving circuit 400, and a compensation signal control terminal CMP, and is configured to, under the control of a compensation control signal provided by the compensation signal control terminal CMP, write the reset voltage to the control terminal of the driving circuit 400 in the case where the reset circuit 100 applies the reset voltage and to write a compensation signal, which is based on the data signal, to the control terminal of the driving circuit 400 in the case where the data writing circuit 200 writes the data signal.

As illustrated in FIG. 2, the driving circuit 400 is connected to the first terminal of the light-emitting element 500, and is configured to control a driving current for driving the light-emitting element 500 to emit light under the control of a voltage applied to the control terminal of the driving circuit 400.

In the pixel circuit 10 provided in this embodiment, the reset circuit 100 can apply the reset voltage to the first terminal of the light-emitting element 500 to reset the first terminal of the light-emitting element 500, and the reset circuit 100 can also apply the reset voltage to the control terminal of the driving circuit 400 via the compensation circuit 300 to reset the control terminal of the driving circuit 400. The reset circuit 100 is not directly connected to the control terminal of the driving circuit 400, thus avoiding the influence of the leakage current in the reset circuit 100 on the signal of the control terminal of the driving circuit 400 in the light-emitting phase in the case where the reset circuit 100 is directly connected to the control terminal of the driving circuit 400. That is, in the light-emitting phase, the leakage current in the reset circuit 100 will not affect the signal of the control terminal of the driving circuit 400, so that the driving current flowing from the driving circuit 400 to the light-emitting element 500 can be kept stable.

Figure 3:
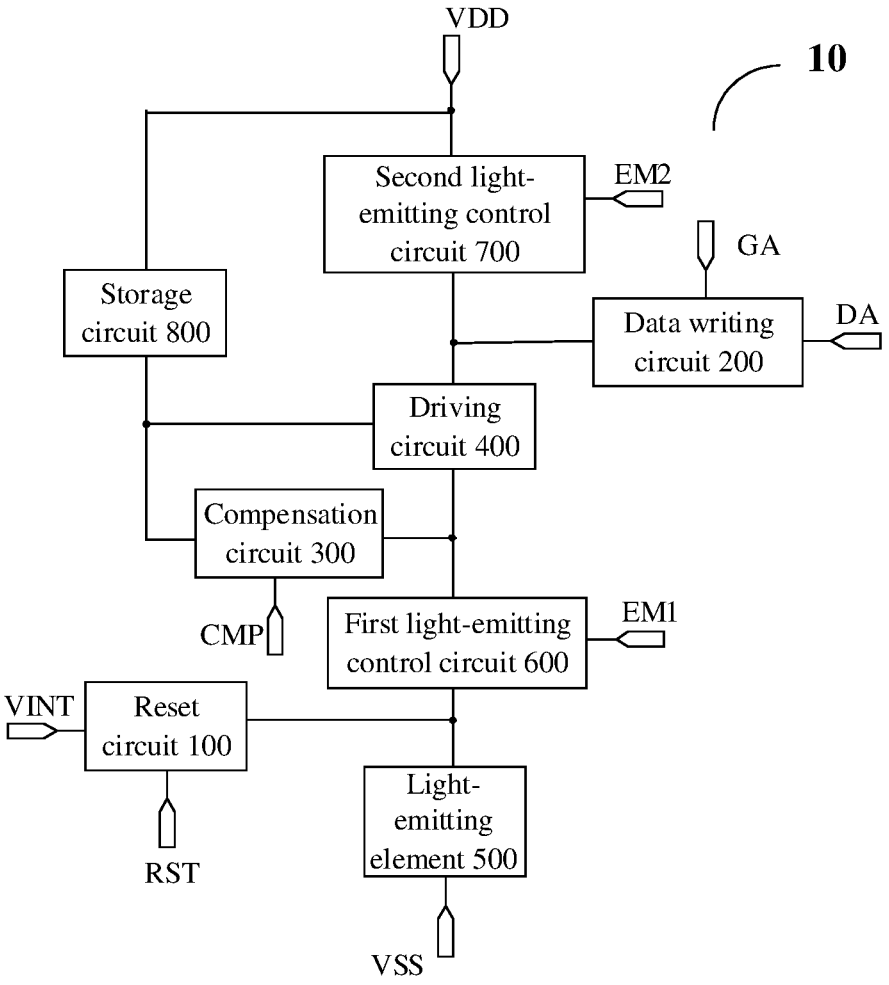
FIG. 3 is a block diagram of another pixel circuit provided by an embodiment of the present disclosure.

FIG. 3 is a block diagram of another pixel circuit provided by an embodiment of the present disclosure. As illustrated in FIG. 3, the pixel circuit 10 further includes a first light-emitting control circuit 600, a second light-emitting control circuit 700, and a storage circuit 800.

As illustrated in FIG. 3, the first light-emitting control circuit 600 is connected to the first terminal of the light-emitting element 500, the second terminal of the driving circuit 400, and a first light-emitting control signal line EM1, and is configured to control a connection between the second terminal of the driving circuit 400 and the first terminal of the light-emitting element 500 (an anode terminal of the light-emitting element 500 in the embodiment) to be turned off or turned on under the control of the first light-emitting control signal provided by the first light-emitting control signal line EM1.

As illustrated in FIG. 3, the second light-emitting control circuit 700 is connected to a first voltage terminal VDD, the first terminal of the driving circuit 400, and a second light-emitting control signal line EM2, and is configured to control a connection between the first voltage terminal VDD and the first terminal of the driving circuit 400 to be turned off or turned on under the control of a second light-emitting control signal provided by the second light-emitting control signal line EM2.

For example, the storage circuit 800 is connected to a second voltage terminal (not shown) and the control terminal of the driving circuit 400, and is configured to store the compensation signal and hold the compensation signal at the control terminal of the driving circuit 400. For example, in some examples, the second voltage terminal and the first voltage terminal VDD are the same voltage terminal, at this time, as illustrated in FIG. 3, the storage circuit 800 is connected to the first voltage terminal VDD and the control terminal of the driving circuit 400.

For example, as illustrated in FIGS. 2 and 3, a second terminal of the light-emitting element 500 (a cathode terminal of the light-emitting element 500 in the embodiment) is connected to a third voltage terminal VSS.

For example, the light-emitting element 500 may be a light-emitting diode or the like. The light-emitting diode can be an organic light-emitting diode (OLED), a quantum dot light-emitting diode (QLED), or the like. The light-emitting element 500 is configured to receive a light-emitting signal (for example, the driving current) and emit light with an intensity corresponding to the light-emitting signal during operation.

Figure 4A:
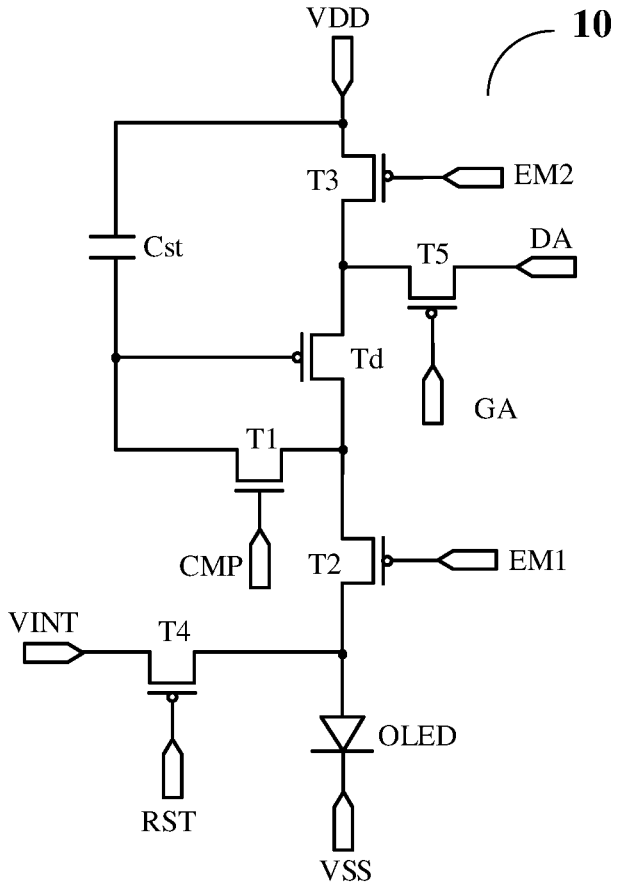
FIG. 4A is a circuit structure diagram of the pixel circuit illustrated in FIG. 3.

FIG. 4A is a circuit structure diagram of the pixel circuit illustrated in FIG. 3. As illustrated in FIG. 4A, in some examples, the compensation circuit 300 includes a first transistor T1, the first light-emitting control circuit 600 includes a second transistor T2, the second light-emitting control circuit 700 includes a third transistor T3, the reset circuit 100 includes a fourth transistor T4, the data writing circuit 200 includes a fifth transistor T5, the driving circuit 400 includes a driving transistor Td, the storage circuit 800 includes a storage capacitor Cst, and the light-emitting element 500 includes an OLED.

For example, the control terminal of the driving circuit 400 includes a gate electrode of the driving transistor Td, the first terminal of the driving circuit 400 includes a first electrode of the driving transistor Td, and the second terminal of the driving circuit 400 includes a second electrode of the driving transistor Td.

As illustrated in FIG. 4A, a gate electrode of the first transistor T1 is connected to the compensation control signal line CMP to receive the compensation control signal, a first electrode of the first transistor T1 is connected to the first electrode of the driving transistor Td and a second electrode of the storage capacitor Cst, and a second electrode of the first transistor T1 is connected to the second electrode of the driving transistor Td and a first electrode of the second transistor T2.

As illustrated in FIG. 4A, a gate electrode of the second transistor T2 is connected to the first light-emitting control signal line EM1 to receive the first light-emitting control signal, a first electrode of the second transistor T2 is connected to the second electrode of the first transistor T1 and the second electrode of the driving transistor Td, and a second electrode of the second transistor T2 is connected to a second electrode of the fourth transistor T4 and the anode of the OLED.

As illustrated in FIG. 4A, a gate electrode of the third transistor T3 is connected to the second light-emitting control signal line EM2 to receive the second light-emitting control signal, a first electrode of the third transistor T3 is connected to the first voltage terminal VDD and a first electrode of the storage capacitor Cst, and a second electrode of the third transistor T3 is connected to a second electrode of the fifth transistor T5 and the first electrode of the driving transistor Td.

For example, the first light-emitting control signal and the second light-emitting control signal are different.

As illustrated in FIG. 4A, a gate electrode of the fourth transistor T4 is connected to the reset control signal line RST to receive the reset control signal, a first electrode of the fourth transistor T4 is connected to the reset voltage terminal VINT to receive the reset voltage, and the second electrode of the fourth transistor T4 is connected to the anode of the OLED and the second electrode of the second transistor T2.

As illustrated in FIG. 4A, a gate electrode of the fifth transistor T5 is connected to the scanning signal line GA to receive the scanning signal, a first electrode of the fifth transistor T5 is connected to the data signal line DA to receive the data signal, and the second electrode of the fifth transistor T5 is connected to the second electrode of the third transistor T3 and the first electrode of the driving transistor Td.

As illustrated in FIG. 4A, the gate electrode of the driving transistor Td is connected to the first electrode of the first transistor T1 and the second electrode of the storage capacitor Cst, the first electrode of the driving transistor Td is connected to the second electrode of the third transistor T3 and the second electrode of the fifth transistor T5, and the second electrode of the driving transistor Td is connected to the second electrode of the first transistor T1 and the first electrode of the second transistor T2.

As illustrated in FIG. 4A, the first electrode of the storage capacitor Cst is connected to the first voltage terminal VDD and the first electrode of the third transistor T3, and the second electrode of the storage capacitor Cst is connected to the first electrode of the first transistor T1 and the gate electrode of the driving transistor Td.

As illustrated in FIG. 4A, the anode of the OLED is connected to the second electrode of the fourth transistor T4 and the second electrode of the second transistor T2, and the cathode of the OLED is connected to the third voltage terminal VSS.

It should be noted that the embodiments of the present disclosure are all described by taking a case that the first voltage terminal VDD inputs a high level, the third voltage terminal VSS inputs a low level, or the third voltage terminal VSS is grounded as an example, and the high and low here only represent the relative magnitude relationship between the input voltages.

It should be noted that all the transistors used in the embodiments of the present disclosure can be thin film transistors, field effect transistors, or other switching devices with the same characteristics, and all the embodiments of the present disclosure are described by taking the case that all the transistors are thin film transistors as an example. The source electrode and the drain electrode of the transistor used here can be symmetrical in structure, so there can be no difference in structure between the source electrode and the drain electrode of the transistor. In the embodiment of the present disclosure, in order to distinguish the two electrodes of the transistor except the gate electrode, it is directly described that one electrode is the first electrode and the other electrode is the second electrode.

In addition, it should be noted that all the transistors used in the embodiments of the present disclosure can be P-type transistors or N-type transistors. As long as respective electrodes of a selected-type transistor are correspondingly connected in accordance with respective electrodes of a corresponding transistor in the embodiment of the present disclosure, and respective voltage terminals provide the corresponding high voltage or low voltage. For example, for an N-type transistor, its (current) input terminal is a drain electrode, its output terminal is a source electrode, and its control terminal is a gate electrode; for a P-type transistor, its (current) input terminal is a source electrode, its output terminal is a drain electrode, and its control terminal is a gate electrode. For different types of transistors, the levels of control signals at control terminals of the different types of transistors are different. For example, for an N-type transistor, in the case where the control signal is at a high level, the N-type transistor is in a turn-on state; and in the case where the control signal is at a low level, the N-type transistor is in a turn-off state. For a P-type transistor, in the case where the control signal is at a low level, the P-type transistor is in a turn-on state, and in the case where the control signal is at a high level, the P-type transistor is in a turn-off state. In the case where an N-type transistor is used, an oxide semiconductor, such as Indium Gallium Zinc Oxide (IGZO), can be used as the active layer of the thin film transistor, and compared with using Low Temperature Poly Silicon (LTPS) or amorphous silicon (such as hydrogenated amorphous silicon) as the active layer of the thin film transistor, it can effectively reduce the size of the transistor and prevent leakage current. Low-temperature polysilicon generally refers to a polysilicon, the crystallization temperature of which obtained by the amorphous silicon crystallization is lower than 600 degrees Celsius.

For example, the driving transistor Td is a polysilicon transistor, the first transistor T1 is an oxide transistor, and a type of the first transistor T1 is opposite to a type of the driving transistor Td.

In the pixel circuit 10 illustrated in FIG. 4A, the first transistor T1 may be an N-type oxide transistor, such as an N-type IGZO transistor, and the driving transistor Td may be a P-type polysilicon transistor, such as a P-type low temperature polysilicon (LTPS) transistor. Because the first transistor T1 adopts an IGZO transistor, the leakage current of the IGZO transistor is relatively small in the case where the IGZO transistor is turned off, so that the influence of the leakage current flowing through the first transistor T1 in the light-emitting phase on the gate voltage of the driving transistor Td can be suppressed, that is, the leakage current flowing through the first transistor T1 in the light-emitting phase has a small influence on the gate voltage of the driving transistor Td, so that the driving current flowing from the driving transistor Td to the OLED via the second transistor T2 can be kept stable. In addition, because the LTPS transistor adopts a double-gate structure, which requires two gate electrodes to meet the requirement of controlling the leakage current, while the IGZO transistor adopts a single gate electrode to meet the requirement of controlling the leakage current, so that the layout space can be reduced when the first transistor T1 adopts a IGZO transistor, which is beneficial to the layout with high PPI.

For example, in the pixel circuit 10 illustrated in FIG. 4A, a type of the third transistor T3 is opposite to the type of the first transistor T1, for example, the first transistor T1 may adopt an N-type transistor and the third transistor T3 may adopt a P-type transistor, or, the first transistor is a P-type transistor and the third transistor T3 is an N-type transistor. In this case, the compensation control signal and the second light-emitting control signal may be signals with the same phase, in this case, the gate electrode of the first transistor T1 and the gate electrode of the third transistor T3 may be connected to the same signal line (e.g., the second light-emitting control signal line EM2) to receive the same signal (e.g., the second light-emitting control signal), thereby saving the number of signal lines and further simplifying the circuit structure.

It should be noted that the type of the third transistor T3 may be the same as the type of the first transistor T1. For example, the first transistor T1 may adopt an N-type transistor, and the third transistor T3 may also adopt an N-type transistor, or, the first transistor is a P-type transistor, and the third transistor T3 may also be a P-type transistor. In this case, the compensation control signal and the second light-emitting control signal may be signals with opposite phases.

For example, in the pixel circuit 10 illustrated in FIG. 4A, the type of the second transistor T2 is the same as a type of the fifth transistor T5, for example, the second transistor T2 may adopt a P-type transistor, and the fifth transistor T5 may also adopt a P-type transistor. In this case, the scanning signal and the first light-emitting control signal may be signals with opposite phases, that is, the phase of the first light-emitting control signal and the phase of the scanning signal are opposite.

Figure 4B:
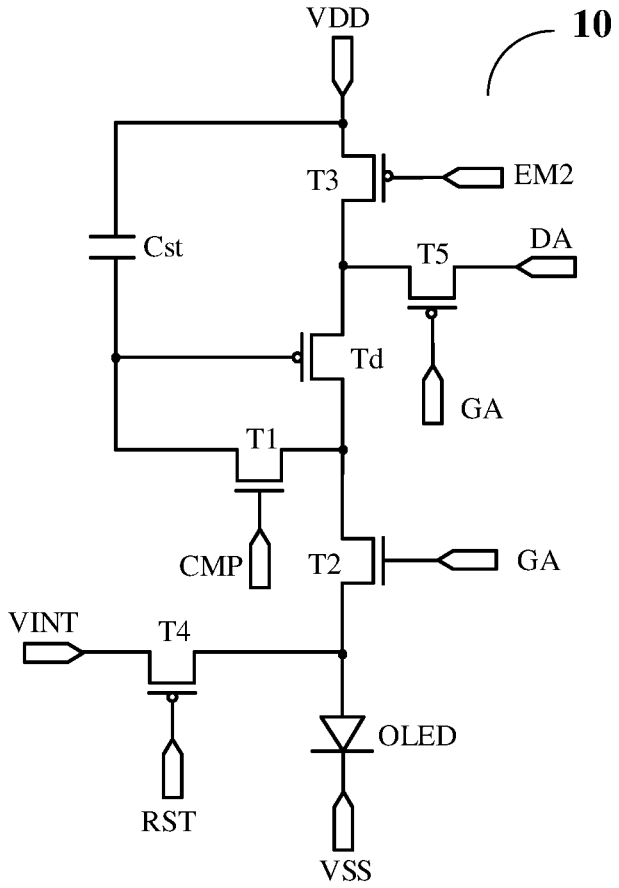
FIG. 4B is another circuit structure diagram of the pixel circuit illustrated in FIG. 3.

It should be noted that the second transistor T2 and the fifth transistor T5 can also be different types of transistors, for example, the second transistor T2 is a P-type transistor and the fifth transistor T5 is an N-type transistor, or, the second transistor T2 is an N-type transistor and the fifth transistor T5 is a P-type transistor. In this case, the scanning signal and the first light-emitting control signal can be signals with the same phase, in this case, the gate electrode of the second transistor T2 and the gate electrode of the fifth transistor T5 can be connected to the same signal line (e.g., the scanning signal line GA) to receive the same signal (e.g., the scanning signal), thereby saving the number of signal lines and further simplifying the circuit structure. For example, FIG. 4B is another circuit structure diagram of the pixel circuit illustrated in FIG. 3. Unlike the pixel circuit 10 illustrated in FIG. 4A, in the pixel circuit 10 illustrated in FIG. 4B, the second transistor T2 may be an N-type transistor, and the fifth transistor T5 may be a P-type transistor, the gate electrode of the second transistor T2 and the gate electrode of the fifth transistor T5 may both be connected to the scanning signal line GA to receive the scanning signal.

In addition, other structures of the pixel circuit 10 illustrated in FIG. 4B are basically the same as or similar to those of the pixel circuit 10 illustrated in FIG. 4A, so that reference can be made to the description of the pixel circuit 10 illustrated in FIG. 4A, the repetition is not repeated herein again.

As illustrated in FIG. 4A and FIG. 4B, in the pixel circuit 10 provided in this embodiment, the fourth transistor T4 may apply the reset voltage to the anode of the OLED to reset the anode of the OLED, and may also apply the reset voltage to the gate electrode of the driving transistor Td via the second transistor T2 and the first transistor T1 to reset the gate electrode of the driving transistor Td. The fourth transistor T4 is not directly connected to the gate electrode of the driving transistor Td, thus avoiding the influence of the leakage current flowing through the fourth transistor T4 in the light-emitting phase on the gate voltage of the driving transistor Td in the case where the fourth transistor T4 is directly connected to the gate electrode of the driving transistor Td, thereby achieving low-frequency driving, so that the driving current flowing from the driving transistor Td to the OLED via the second transistor T2 can be kept stable, thereby preventing the OLED from flickering in the light-emitting process.

Figure 5:
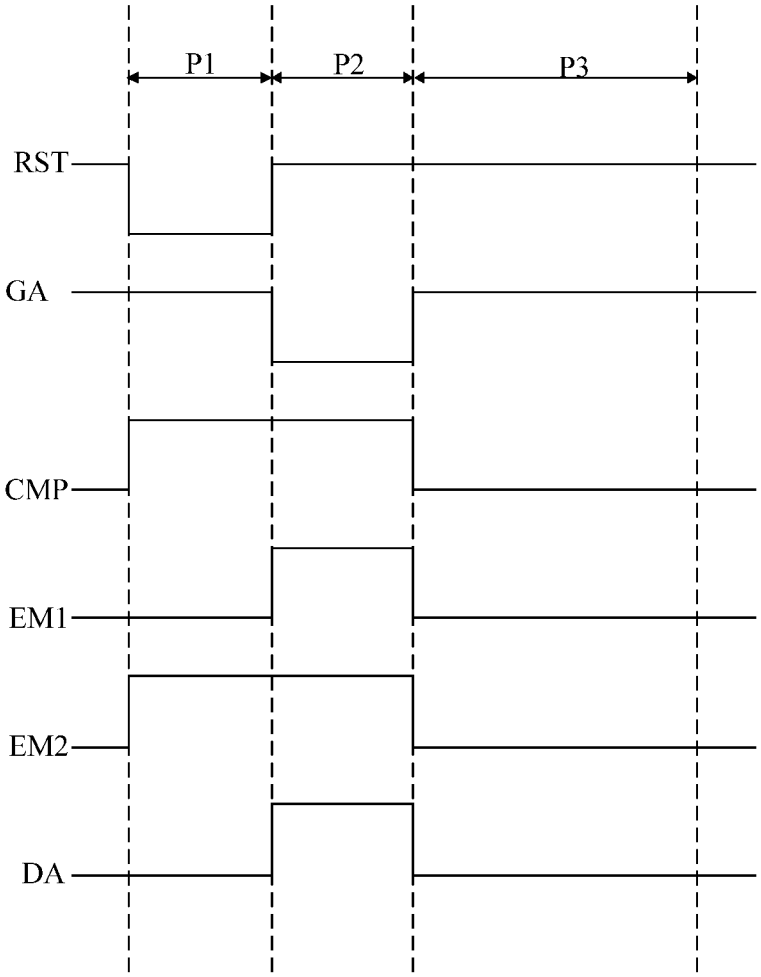
FIG. 5 is a timing chart of signals for driving the pixel circuit illustrated in FIG. 4A.

FIG. 5 is a timing chart of signals for driving the pixel circuit illustrated in FIG. 4A. As illustrated in FIG. 5, the working process of the pixel circuit 10 includes three phases, namely, a reset phase P1, a charging phase P2, and a light-emitting phase P3, and the timing waveform of each signal in each phase is illustrated in FIG. 5.

Figure 6A:
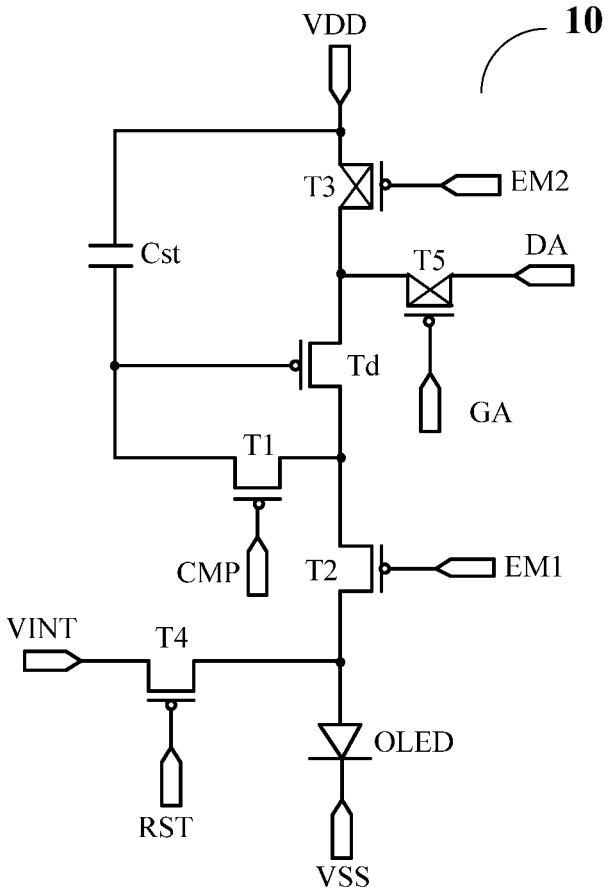
FIG. 6A is an equivalent circuit diagram of the pixel circuit illustrated in FIG. 4A in a reset phase.
Figure 6B:
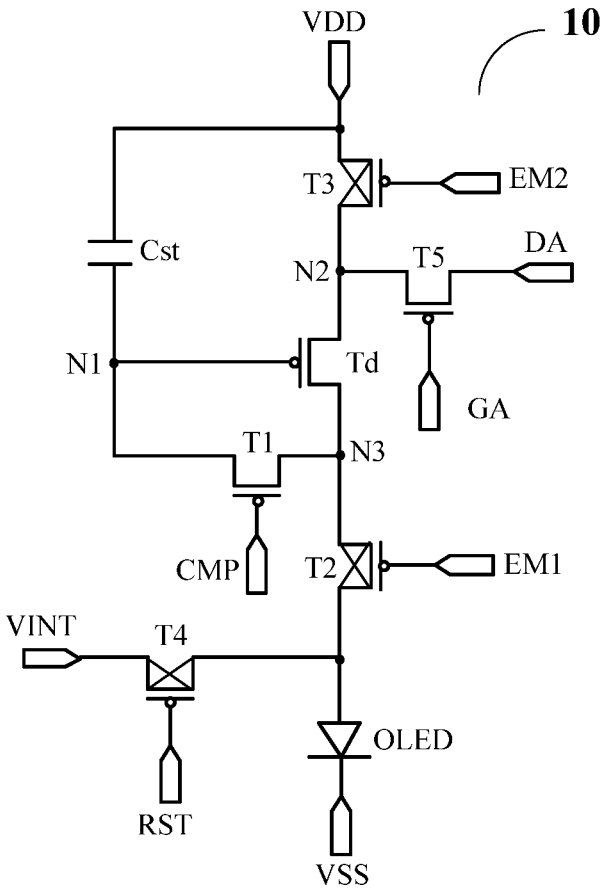
FIG. 6B is an equivalent circuit diagram of the pixel circuit illustrated in FIG. 4A in a charging phase.
Figure 6C:
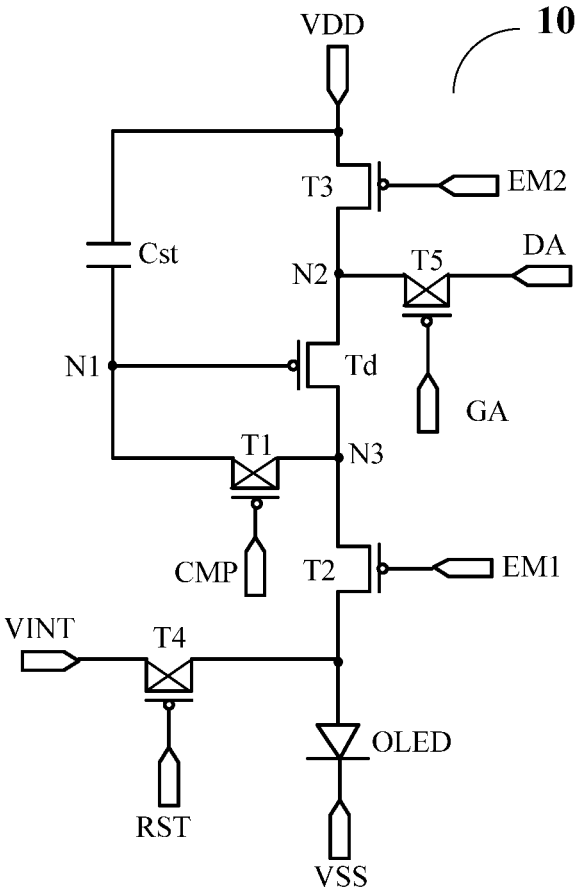
FIG. 6C is an equivalent circuit diagram of the pixel circuit illustrated in FIG. 4A in a light-emitting phase.

FIG. 6A is an equivalent circuit diagram of the pixel circuit illustrated in FIG. 4A at the reset phase. FIG. 6B is an equivalent circuit diagram of the pixel circuit illustrated in FIG. 4A at the charging phase. FIG. 6C is an equivalent circuit diagram of the pixel circuit illustrated in FIG. 4A at the light-emitting phase.

In FIG. 5 and FIGS. 6A, 6B, and 6C, VDD, VSS, VINT, RST, GA, CMP, EM1, EM2, and DA are used to represent both corresponding signal lines and corresponding signals. In addition, the transistors marked with "X" in FIGS. 6A, 6B, and 6C indicate that the transistors are in the turn-off state in the corresponding phases.

With reference to FIG. 5, FIG. 6A, FIG. 6B, and FIG. 6C, the working principle of the pixel circuit illustrated in FIG. 4A will be described by taking the case that the first transistor T1 is an N-type IGZO transistor and other transistors are P-type transistors as an example.

In the reset phase P1, the reset control signal RST is input to the gate electrode of the fourth transistor T4 (i.e., the reset circuit 100) to turn on the fourth transistor T4, the first light-emitting control signal EM1 is input to the gate electrode of the second transistor T2 (i.e., the first light-emitting control circuit 600) to turn on the second transistor T2, and the compensation control signal CMP is input to the gate electrode of the first transistor T1 (i.e., the compensation circuit 300) to turn on the first transistor T1. Therefore, the reset voltage VINT is applied to the anode of the OLED (i.e., the first terminal of the light-emitting element 500) to reset the anode of the OLED, and the reset voltage VINT is applied to the gate electrode of the driving transistor Td (i.e., the control terminal of the driving circuit 400) to reset the gate electrode of the driving transistor Td.

As illustrated in FIGS. 5 and 6A, in the reset phase P1, the fourth transistor T4 is turned on by the low level of the reset control signal RST, the second transistor T2 is turned on by the low level of the first light-emitting control signal EM1, and the first transistor T1 is turned on by the high level of the compensation control signal CMP. Meanwhile, the third transistor T3 and the fifth transistor T5 are turned off.

As illustrated in FIG. 6A, in the reset phase P1, because the fourth transistor T4 is turned on, the reset voltage VINT can be applied to the anode of the OLED, so that the anode of the OLED can be reset. Meanwhile, because the second transistor T2 and the first transistor T1 are turned on, the reset voltage VINT can be applied to the gate electrode of the driving transistor Td, so that the gate electrode of the driving transistor Td can be reset, so that the driving transistor Td enters the charging phase P2 in a turn-on state.

In the charging phase P2, the scanning signal GA is input to the gate electrode of the fifth transistor T5 (i.e., the data writing circuit 200) to turn on the fifth transistor T5, the fifth transistor T5 writes the data signal DA to the first electrode of the driving transistor Td; the compensation control signal CMP is input to the gate electrode of the first transistor T1 to turn on the first transistor T1, and the first transistor T1 writes the compensation signal, which is based on the data signal DA, to the gate electrode of the driving transistor Td. The voltage of the compensation signal can be expressed as Vcm=Vda+Vth, where Vda represents the voltage of the data signal DA and Vth represents the threshold voltage of the driving transistor Td.

As illustrated in FIGS. 5 and 6B, in the charging phase P2, the fifth transistor T5 is turned on by the low level of the scanning signal GA, and the first transistor T1 is turned on by the high level of the compensation control signal CMP; and at the same time, the second transistor T2, the third transistor T3, and the fourth transistor T4 are turned off.

As illustrated in FIG. 6B, in the charging phase P2, the data signal DA passes through the fifth transistor T5, the driving transistor Td, and the first transistor T1 and then charges (i.e., charges the storage capacitor Cst) the first node N1 (i.e., the gate electrode of the driving transistor Td), that is, the potential of the first node N1 gradually increases. It can be easily understood that because the fifth transistor T5 is turned on, the potential of the second node N2 (i.e., the first electrode of the driving transistor Td) is kept at Vda, at the same time, according to the own characteristics of the driving transistor Td, in the case where the potential of the first node N1 increases to Vda+Vth, the driving transistor Td is turned off, the charging process ends, and the threshold voltage of the driving transistor Td is compensated at the same time. It should be noted that, in this embodiment, because the driving transistor Td is exemplified by a P-type transistor, the threshold voltage Vth here can be a negative value.

After the charging phase P2, the potential of the first node N1 and the potential of the third node N3 (i.e., the second electrode of the driving transistor Td) are both Vda+Vth, that is, the compensation signal with the voltage information of the data signal DA and the threshold voltage Vth is stored in the storage capacitor Cst.

In the light-emitting phase P3, the first light-emitting control signal EM1 is input to the gate electrode of the second transistor T2 (i.e., the first light-emitting control circuit 500) to turn on the second transistor T2, and the second light-emitting control signal EM2 is input to the gate electrode of the third transistor T3 (i.e., the second light-emitting control circuit 700) to turn on the third transistor T3. Therefore, the first voltage terminal VDD, the driving transistor Td, the second transistor T2, the third transistor T3, the OLED, and the third voltage terminal VSS can form a loop, and the driving current is transmitted to the OLED via the turned-on driving transistor Td, the turned-on second transistor T2, and the turned-on third transistor T3 to drive the OLED to emit light.

For example, the compensation signal can control the conduction degree of the driving transistor Td, thereby controlling the magnitude of the driving current flowing through the driving transistor Td, and the driving current flowing through the driving transistor Td can determine the brightness of the OLED when emitting light.

As illustrated in FIGS. 5 and 6C, in the light-emitting phase P3, the second transistor T2 is turned on by the low level of the first light-emitting control signal EM1, and the third transistor T3 is turned on by the low level of the second light-emitting control signal EM2. At the same time, the first transistor T1, the fourth transistor T4, and the fifth transistor T5 are all turned off; and in this case, the potential of the first node N1 is Vda+Vth, and the potential of the second node N2 is VDD, so the driving transistor Td is also kept on in this phase.

As illustrated in FIG. 6C, in the light-emitting phase P3, the anode and cathode of the OLED are connected to the first voltage VDD (the high voltage) and the third voltage VSS (the low voltage), respectively, and the OLED emits light under the action of the driving current of the driving transistor Td.

Based on the saturation current formula of the driving transistor Td, the value of the driving current $I_D$ flowing through the OLED can be obtained according to the following formula:

$$\begin{aligned} I_D &= K(V_{GS} - Vth)^2 \\ &= K[(Vda + Vth - VDD) - Vth]^2 \\ &= K(Vda - VDD)^2. \end{aligned}$$

In the above formula, Vth represents the threshold voltage of the driving transistor Td, $V_{GS}$ represents the voltage difference between the gate electrode and the source electrode of the driving transistor Td, and K is a constant.

It can be seen from the above formula that the driving current $I_D$ flowing through the OLED is only related to the voltage Vda of the data signal DA and the first voltage VDD, and is no longer related to the threshold voltage Vth of the driving transistor Td, thus achieving threshold compensation for the pixel circuit, solving the problem of the threshold voltage drift of the driving transistor Td due to the process and long-time operation, and eliminating the influence of the threshold voltage drift on the driving current $I_D$, thus improving the display effect.

For example, K in the above formula can be expressed as:

$$K=0.5\mu_n C_{ox}(W/L),$$

where $\mu_n$ is an electron mobility of the driving transistor Td, $C_{ox}$ is the gate unit capacitance of the driving transistor Td, W is the channel width of the driving transistor Td, and L is the channel length of the driving transistor Td.

As illustrated in FIG. 6A, in the pixel circuit 10 provided in this embodiment, in the reset phase P1, the fourth transistor T4 can reset the anode of the OLED and the gate electrode of the driving transistor Td at the same time, and the fourth transistor T4 is not directly connected to the gate electrode of the driving transistor Td, thus avoiding the influence of the leakage current flowing through the fourth transistor T4 on the gate voltage of the driving transistor Td (i.e., the potential of the first node N1), so that the driving current flowing from the driving transistor Td to the OLED via the second transistor T2 can be kept stable and the OLED is prevented from flickering in the light-emitting process.

In addition, as illustrated in FIG. 6C, in the pixel circuit 10 provided in this embodiment, the first transistor T1 is an IGZO thin film transistor, and the leakage current flowing through the IGZO thin film transistor itself is relatively small in the case where the IGZO thin film transistor is turned off, which can reduce the influence of the leakage current flowing through the first transistor T1 in the light-emitting phase P3 on the gate voltage of the driving transistor Td (i.e., the potential of the first node N1), so that the driving current flowing from the driving transistor Td to the OLED via the second transistor T2 can be kept stable, and the OLED can be prevented from flickering in the light-emitting process.

It is worth noting that the reset circuit 100, the data writing circuit 200, the compensation circuit 300, the driving circuit 400, the first light-emitting control circuit 600, the second light-emitting control circuit 700, and the storage circuit 800 are not limited to the structures described in the above embodiments, and their specific structures can be set according to actual application requirements, and the embodiments of the present disclosure do not limit this.

An embodiment of the present disclosure provides a display panel including the pixel circuit provided by any embodiment of the present disclosure.

Figure 7:
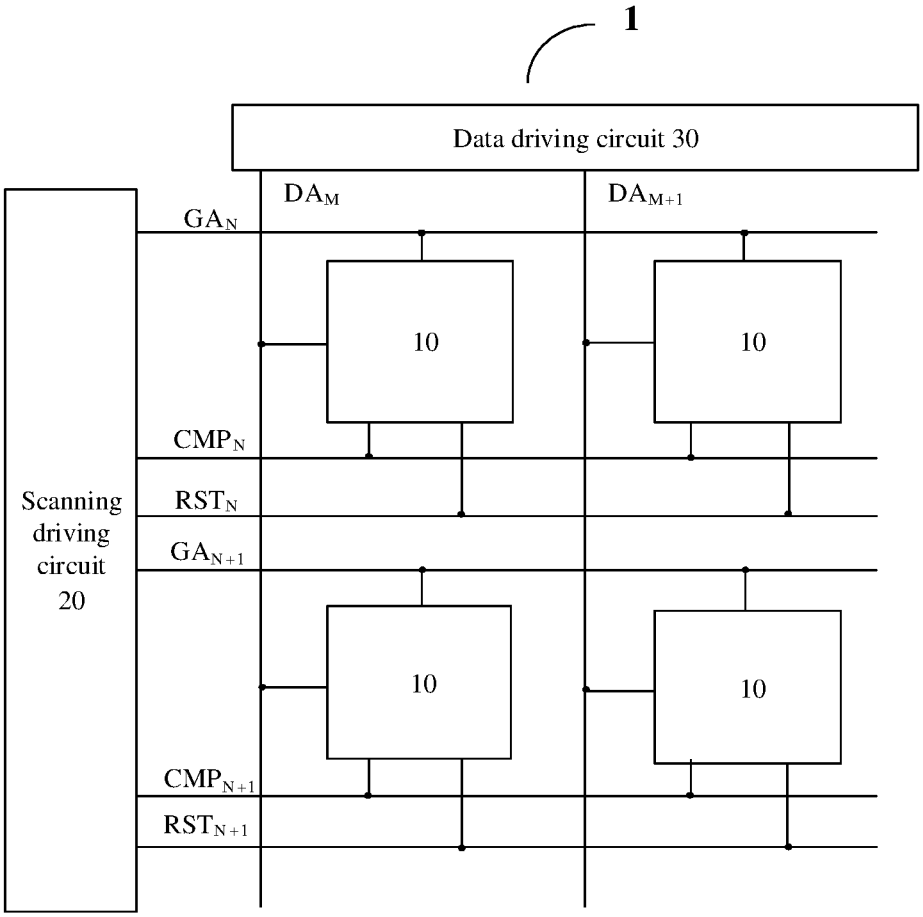
FIG. 7 is a schematic diagram of a display panel provided by an embodiment of the present disclosure.

FIG. 7 is a schematic diagram of a display panel provided by an embodiment of the present disclosure. As illustrated in FIG. 7, the display panel 1 may include a pixel array, a plurality of scanning signal lines, a plurality of data signal lines, a plurality of reset control signal lines, and a plurality of compensation control signal lines. The pixel array may include a plurality of pixel units arranged in an array, at least one pixel unit includes any of the pixel circuits 10 provided in the above embodiments. For example, in some embodiments, each pixel unit 40 of the plurality of pixel units may include any of the pixel circuits 10 provided in the above embodiments, for example, each pixel unit 40 includes the pixel circuit 10 illustrated in FIG. 4A.

It should be noted that only part of the pixel units 10, part of the scanning signal lines, part of the data signal lines, part of the reset control signal lines, and part of the compensation control signal lines are illustrated in FIG. 7. For example, $GA_N$ represents a scanning signal line corresponding to pixel units in an N-th row, and $GA_{N+1}$ represents a scanning signal line corresponding to pixel units in a (N+1)-th row; $RST_N$ represents a reset control signal line corresponding to the pixel units in the N-th row, and $RST_{N+1}$ represents the reset control signal line corresponding to the pixel units in the (N+1)-th row; $CMP_N$ represents a compensation control signal line corresponding to the pixel units in the N-th row, and $CMP_{N+1}$ represents the compensation control signal line corresponding to the pixel units in the (N+1)-th row, $DA_M$ represents a data signal line corresponding to pixel units in an M-th column, and $DA_{M+1}$ represents a data signal line corresponding to pixel units in a (M+1)-th column. Here, N and M are integers greater than 0, for example.

For example, the scanning signal line corresponding to each row of pixel units is connected to data writing circuits 200 of all pixel circuits in the row to provide the scanning signal GA; a data signal line corresponding to each column of pixel units is connected to the data writing circuits 200 of all pixel circuits in the column to provide the data signal DA; a reset control signal line corresponding to each row of pixel units is connected to the reset circuits 100 of all pixel circuits in the row to provide the reset control signal RST (not illustrated in the figure); a compensation control signal line corresponding to each row of pixel units is connected to the compensation circuits 300 of all pixel circuits in the row to provide the compensation control signal CMP (not illustrated in the figure).

For example, the display panel 1 illustrated in FIG. 7 may further include a plurality of voltage lines to respectively provide a first voltage VDD, a third voltage VSS, a reset voltage VINT (not illustrated in the figure), and the like.

For example, in the case where the pixel circuit 10 includes a first light-emitting control circuit 600 and a second light-emitting control circuit 700, the display panel 1 illustrated in FIG. 7 may further include a plurality of light-emitting control signal lines to respectively provide the first light-emitting control signal EM1 and the second light-emitting control signal EM2 (not illustrated in the figure).

For example, as illustrated in FIG. 7, the display panel 1 may further include a scanning driving circuit 20 and a data driving circuit 30.

For example, the data driving circuit 30 may be connected to the plurality of data signal lines ($DA_M$, $DA_{M+1}$, etc.) to provide the data signal DA, and may also be connected to the plurality of voltage lines (not illustrated in the figure) to provide the first voltage VDD, the third voltage VSS, and the reset voltage VINT, respectively.

For example, the scanning driving circuit 20 may be connected to the plurality of scanning signal lines ($GA_N$, $GA_{N+1}$, etc.) to provide the scanning signal GA, the plurality of compensation control signal lines ($CMP_N$, $CMP_{N+1}$, etc.) to provide the compensation control signal CMP, and the plurality of reset control signal lines ($RST_N$, $RST_{N+1}$, etc.) to provide the reset control signal RST.

For example, in some embodiments, reset circuits in all pixel circuits of pixel units in the (N+1)-th row may be connected to the scanning signal line $GA_N$ corresponding to the pixel units in the N-th row, so that the scanning signal provided by the scanning signal line $GA_N$ corresponding to the pixel units in the N-th row can be used as the reset control signal applied to the reset circuits in all pixel circuits of pixel units in the (N+1)-th row. In this case, the display panel 1 can not be provided with the reset control signal lines, and can achieve the control of the reset circuit only by the scanning signal lines, thereby reducing the number of signal lines in the display panel 1, simplifying wiring, and saving production costs.

For example, the scanning driving circuit 20 and the data driving circuit 30 may be implemented as semiconductor chips. The display panel 1 may also include other components, such as a timing controller, a signal decoding circuit, a voltage conversion circuit, etc., these components may, for example, adopt existing conventional components, which will not be described in detail herein again.

For example, the display panel 1 may be a rectangular panel, a circular panel, an oval panel, or a polygonal panel, and the like. In addition, the display panel 1 may be not only a flat panel, but also a curved panel or even a spherical panel. For example, the display panel 1 may also have a touch function, that is, the display panel 70 may be a touch display panel.

For example, the display panel 1 can be applied to any products or components with display functions, such as mobile phones, tablet computers, televisions, monitors, notebook computers, digital photo frames, and navigators, and the like.

The display panel provided by the embodiment of the present disclosure has the same or similar beneficial effects as the pixel circuit provided by the previous embodiment of the present disclosure, because the pixel circuit has been described in detail in the previous embodiment, the repetition will not be repeated here.

Embodiments of the present disclosure also provide a driving method of the pixel circuit of the above embodiments, and the driving method is used to drive the pixel circuit provided by any one of the embodiments of the present disclosure.

Figure 8:
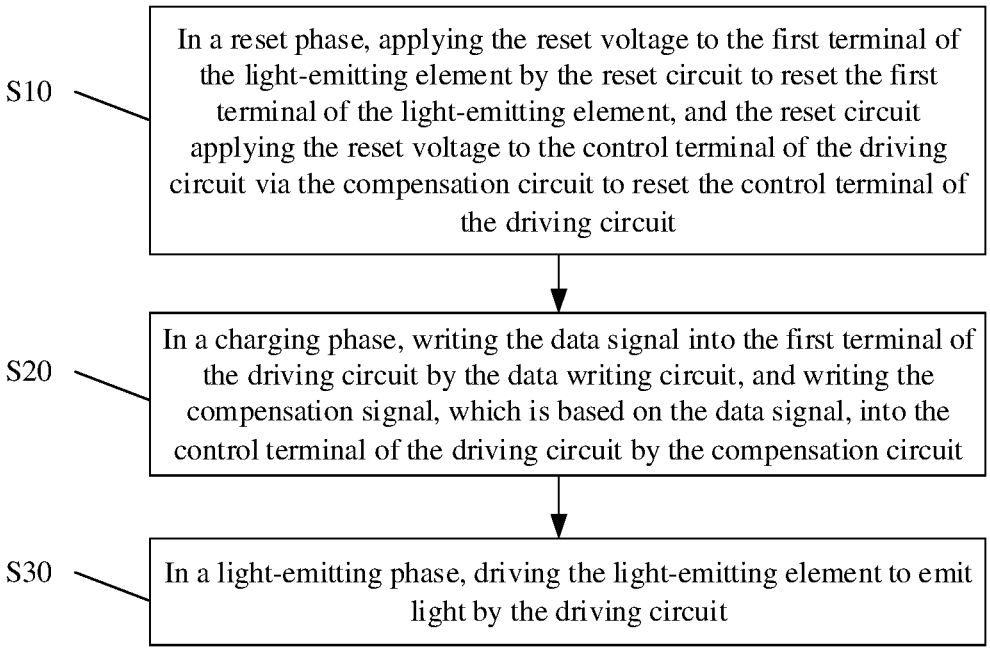
FIG. 8 is a flowchart of a driving method of a pixel circuit provided by an embodiment of the present disclosure.

FIG. 8 is a flowchart of a driving method for the pixel circuit of the above embodiment provided by an embodiment of the present disclosure. As illustrated in FIG. 8, the driving method of the pixel circuit may include the following steps.

S10: in a reset phase, applying the reset voltage to the first terminal of the light-emitting element by the reset circuit to reset the first terminal of the light-emitting element, and the reset circuit applying the reset voltage to the control terminal of the driving circuit via the compensation circuit to reset the control terminal of the driving circuit.

S20: in a charging phase, writing the data signal into the first terminal of the driving circuit by the data writing circuit, and writing the compensation signal, which is based on the data signal, into the control terminal of the driving circuit by the compensation circuit.

S30: in a light-emitting phase, driving the light-emitting element to emit light by the driving circuit.

For example, the reset circuit 100 includes the fourth transistor T4 as illustrated in FIG. 4A; the driving circuit 400 includes the driving transistor Td as illustrated in FIG. 4A, the control terminal of the driving circuit 400 includes the gate electrode of the driving transistor Td, and the driving transistor Td can adopt a P-type LTPS transistor; the compensation circuit 300 includes the first transistor T1 as illustrated in FIG. 4A, and the first transistor T1 may adopt an N-type IGZO transistor.

For example, in the reset phase S10, as illustrated in FIG. 6A, the fourth transistor T4 is turned on under the control of the reset control signal and the first transistor T1 is turned on under the control of the compensation control signal, at this time, the reset voltage can be applied to the first terminal of the light-emitting element through the fourth transistor T4 to reset the first terminal of the light-emitting element, and the fourth transistor T4 can also apply the reset voltage to the gate electrode of the driving transistor Td via the first transistor T1 to reset the gate electrode of the driving transistor Td.

The detailed description and technical effects of the driving method of the pixel circuit provided by the embodiment of the present disclosure can refer to the corresponding description in the embodiment of the pixel circuit, and the repetition will not be repeated herein again.

For the present disclosure, the following statements should be noted:

(1) The accompanying drawings of the embodiment(s) of the present disclosure involve only the structure(s) in connection with the embodiment(s) of the present disclosure, and other structure(s) can refer to common design(s).

(2) In case of no conflict, the embodiments of the present disclosure and the features in the embodiment(s) can be combined with each other to obtain new embodiment(s).

What have been described above are only specific implementations of the present disclosure, the protection scope of the present disclosure is not limited thereto, and the protection scope of the present disclosure should be based on the protection scope of the claims.

What is claimed is:

1. A pixel circuit, comprising: a reset circuit, a data writing circuit, a compensation circuit, and a driving circuit, wherein the reset circuit is connected to a first terminal of a light-emitting element, and is configured to apply a reset voltage to the first terminal of the light-emitting element under control of a reset control signal to reset the first terminal of the light-emitting element;

the data writing circuit is connected to a first terminal of the driving circuit, and is configured to write a data signal to the first terminal of the driving circuit under control of a scanning signal;

the compensation circuit is connected to a second terminal and a control terminal of the driving circuit, and is configured to, under control of a compensation control signal, write the reset voltage into the control terminal of the driving circuit in a case where the reset circuit applies the reset voltage, and to write a compensation signal, which is based on the data signal, into the control terminal of the driving circuit in a case where the data writing circuit writes the data signal; and the driving circuit is configured to control a driving current for driving the light-emitting element to emit light under control of a voltage applied to the control terminal of the driving circuit;

the pixel circuit further comprises a first light-emitting control circuit, the first light-emitting control circuit is connected to the first terminal of the light-emitting element and the second terminal of the driving circuit, and is configured to control a connection between the second terminal of the driving circuit and the first terminal of the light-emitting element to be turned off or turned on under control of a first light-emitting control signal;

the first light-emitting control circuit comprises a second transistor, a gate electrode of the second transistor is configured to receive the first light-emitting control signal, a first electrode of the second transistor is connected to the second terminal of the driving circuit, and a second electrode of the second transistor is connected to the first terminal of the light-emitting element;

the data writing circuit comprises a fifth transistor, a gate electrode of the fifth transistor is configured to receive the scanning signal, a first electrode of the fifth transistor is configured to receive the data signal, and a second electrode of the fifth transistor is connected to the first terminal of the driving circuit;

a type of the second transistor is identical to a type of the fifth transistor, and a phase of the first light-emitting control signal is opposite to a phase of the scanning signal; or, the type of the second transistor is opposite to the type of the fifth transistor, and the phase of the first light-emitting control signal is identical to the phase of the scanning signal.

2. The pixel circuit according to claim 1, wherein the driving circuit comprises a driving transistor, the control terminal of the driving circuit comprises a gate electrode of the driving transistor, the first terminal of the driving circuit comprises a first electrode of the driving transistor, and a second terminal of the driving circuit comprises a second electrode of the driving transistor.

3. The pixel circuit according to claim 2, wherein the compensation circuit comprises a first transistor, a gate electrode of the first transistor is configured to receive the compensation control signal, a first electrode of the first transistor is connected to the second terminal of the driving circuit, and a second electrode of the first transistor is connected to the control terminal of the driving circuit.

4. The pixel circuit according to claim 3, wherein the driving transistor is a polysilicon transistor, the first transistor is an oxide transistor, and a type of the first transistor is opposite to a type of the driving transistor.

5. The pixel circuit according to claim 1, further comprising a second light-emitting control circuit, wherein the second light-emitting control circuit is connected to a first voltage terminal and the first terminal of the driving circuit, and is configured to control a connection between the first voltage terminal and the first terminal of the driving circuit to be turned off or tuned on under control of a second light-emitting control signal.

6. The pixel circuit according to claim 5, wherein the second light-emitting control circuit comprises a third transistor, a gate electrode of the third transistor is configured to receive the second light-emitting control signal, a first electrode of the third transistor is connected to the first voltage terminal, and a second electrode of the third transistor is connected to the first terminal of the driving circuit.

7. The pixel circuit according to claim 6, wherein a type of the third transistor is opposite to a type of the first transistor, and a phase of the second light-emitting control signal is identical to a phase of the compensation control signal; or, the type of the third transistor is identical to the type of the first transistor, and the phase of the second light-emitting control signal is opposite to the phase of the compensation control signal.

8. The pixel circuit according to claim 5, wherein the first light-emitting control signal and the second light-emitting control signal are different.

9. The pixel circuit according to claim 1, wherein the reset circuit comprises a fourth transistor, a gate electrode of the fourth transistor is configured to receive the reset control signal, a first electrode of the fourth transistor is connected to a reset voltage terminal to receive the reset voltage, and a second electrode of the fourth transistor is connected to the first terminal of the light-emitting element.

10. The pixel circuit according to claim 1, further comprising a storage circuit, wherein the storage circuit is configured to store the compensation signal and hold the compensation signal at the control terminal of the driving circuit.

11. The pixel circuit according to claim 10, wherein the storage circuit comprises a storage capacitor, a first terminal of the storage capacitor is connected to a second voltage terminal, and a second terminal of the storage capacitor is connected to the control terminal of the driving circuit.

12. A pixel circuit, comprising: a reset circuit, a data writing circuit, a compensation circuit, a storage circuit, a driving circuit, a first light-emitting control circuit, and a second light-emitting control circuit, wherein the driving circuit comprises a driving transistor, the compensation circuit comprises a first transistor, the first light-emitting control circuit comprises a second transistor, the second light-emitting control circuit comprises a third transistor, the reset circuit comprises a fourth transistor, the data writing circuit comprises a fifth transistor, and the storage circuit comprises a storage capacitor;

a gate electrode of the first transistor is configured to receive a compensation control signal, a first electrode of the first transistor is connected to a second electrode of the driving transistor, and a second electrode of the first transistor is connected to a gate electrode of the driving transistor;

a gate electrode of the second transistor is configured to receive a first light-emitting control signal, a first electrode of the second transistor is connected to the second electrode of the driving transistor, and a second electrode of the second transistor is connected to a first terminal of a light-emitting element;

a gate electrode of the third transistor is configured to receive a second light-emitting control signal, a first electrode of the third transistor is connected to a first voltage terminal, and a second electrode of the third transistor is connected to a first electrode of the driving transistor;

a gate electrode of the fourth transistor is configured to receive a reset control signal, a first electrode of the fourth transistor is configured to receive a reset voltage, and a second electrode of the fourth transistor is connected to the first terminal of the light-emitting element;

a gate electrode of the fifth transistor is configured to receive a scanning signal, a first electrode of the fifth transistor is configured to receive a data signal, and a second electrode of the fifth transistor is connected to the first electrode of the driving transistor;

a first terminal of the storage capacitor is connected to a second voltage terminal, and a second terminal of the storage capacitor is connected to the gate electrode of the driving transistor; and a second terminal of the light-emitting element is connected to a third voltage terminal, wherein the driving transistor is a polysilicon transistor, the first transistor is an oxide transistor, and a type of the first transistor is opposite to a type of the driving transistor; and the first transistor is configured to, under control of the compensation control signal, write the reset voltage to the gate electrode of the driving transistor in a case where the fourth transistor applies the reset voltage, and to write a compensation signal, which is based on the data signal, to the gate electrode of the driving transistor in a case where the fifth transistor writes the data signal;

a type of the second transistor is identical to a type of the fifth transistor, and a phase of the first light-emitting control signal is opposite to a phase of the scanning signal; or, the type of the second transistor is opposite to the type of the fifth transistor, and the phase of the first light-emitting control signal is identical to the phase of the scanning signal.

13. A display panel, comprising a pixel array, wherein the pixel array comprises a plurality of pixel units, and at least one pixel unit of the plurality of pixel units comprises the pixel circuit according to claim 1.

14. A driving method for driving a pixel circuit, wherein the pixel circuit comprises: a reset circuit, a data writing circuit, a compensation circuit, a driving circuit, and a first light-emitting control circuit, the reset circuit is connected to a first terminal of a light-emitting element, and is configured to apply a reset voltage to the first terminal of the light-emitting element under control of a reset control signal to reset the first terminal of the light-emitting element;

the data writing circuit is connected to a first terminal of the driving circuit, and is configured to write a data signal to the first terminal of the driving circuit under control of a scanning signal;

the compensation circuit is connected to a second terminal and a control terminal of the driving circuit, and is configured to, under control of a compensation control signal, write the reset voltage into the control terminal of the driving circuit in a case where the reset circuit applies the reset voltage, and to write a compensation signal, which is based on the data signal, into the control terminal of the driving circuit in a case where the data writing circuit writes the data signal; and the driving circuit is configured to control a driving current for driving the light-emitting element to emit light under control of a voltage applied to the control terminal of the driving circuit, the first light-emitting control circuit is connected to the first terminal of the light-emitting element and the second terminal of the driving circuit, and is configured to control a connection between the second terminal of the driving circuit and the first terminal of the light-emitting element to be turned off or turned on under control of a first light-emitting control signal;

the first light-emitting control circuit comprises a second transistor, a gate electrode of the second transistor is configured to receive the first light-emitting control signal, a first electrode of the second transistor is connected to the second terminal of the driving circuit, and a second electrode of the second transistor is connected to the first terminal of the light-emitting element;

the data writing circuit comprises a fifth transistor, a gate electrode of the fifth transistor is configured to receive the scanning signal, a first electrode of the fifth transistor is configured to receive the data signal, and a second electrode of the fifth transistor is connected to the first terminal of the driving circuit;

a type of the second transistor is identical to a type of the fifth transistor, and a phase of the first light-emitting control signal is opposite to a phase of the scanning signal; or, the type of the second transistor is opposite to the type of the fifth transistor, and the phase of the first light-emitting control signal is identical to the phase of the scanning signal;

the driving method comprises:

in a reset phase, applying the reset voltage to the first terminal of the light-emitting element by the reset circuit to reset the first terminal of the light-emitting element, and the reset circuit applying the reset voltage to the control terminal of the driving circuit via the compensation circuit to reset the control terminal of the driving circuit;

in a charging phase, writing the data signal into the first terminal of the driving circuit by the data writing circuit, and writing the compensation signal, which is based on the data signal, into the control terminal of the driving circuit by the compensation circuit; and in a light-emitting phase, driving the light-emitting element to emit light by the driving circuit.

15. The driving method according to claim 14, wherein the reset circuit comprises a fourth transistor; the driving circuit comprises a driving transistor, and the control terminal of the driving circuit comprises a gate electrode of the driving transistor; and the compensation circuit comprises a first transistor; and in the reset phase, the fourth transistor is turned on under control of the reset control signal, the first transistor is turned on under control of the compensation control signal, the reset voltage is applied to the first terminal of the light-emitting element by the fourth transistor to reset the first terminal of the light-emitting element, and the fourth transistor applies the reset voltage to the gate electrode of the driving transistor via the first transistor to reset the gate electrode of the driving transistor.

* * * * *